US010172426B2

(12) United States Patent
Hsu et al.

(10) Patent No.: US 10,172,426 B2
(45) Date of Patent: Jan. 8, 2019

(54) MAGNETIC BAND CLASP

(71) Applicant: Apple Inc., Cupertino, CA (US)

(72) Inventors: Jen-Chun Hsu, Taipei (TW); Osamu Yabe, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 464 days.

(21) Appl. No.: 14/884,588

(22) Filed: Oct. 15, 2015

(65) Prior Publication Data

US 2017/0071298 A1 Mar. 16, 2017

Related U.S. Application Data

(60) Provisional application No. 62/219,562, filed on Sep. 16, 2015.

(51) Int. Cl.
*A44C 5/20* (2006.01)
*A41F 1/00* (2006.01)

(52) U.S. Cl.
CPC ..... *A44C 5/2071* (2013.01); *A41F 1/002* (2013.01)

(58) Field of Classification Search
CPC ... A44D 2203/00; Y10T 24/32; A44C 5/2071; A44C 5/0015; A41C 1/002
See application file for complete search history.

(56) References Cited

U.S. PATENT DOCUMENTS 3,579,159 A 5/1971 Posey
3,815,066 A 6/1974 Vinal
3,873,957 A 3/1975 Wurscher et al.
3,906,417 A 9/1975 Serras-Paulet
3,938,642 A 2/1976 Van Rumpt et al.
4,054,944 A 10/1977 Lau
4,280,214 A 7/1981 Kunii et al.
4,453,148 A 6/1984 Norakidze et al.
4,868,530 A 9/1989 Ahs
4,941,236 A 7/1990 Sherman et al.
5,076,623 A 12/1991 Richards
5,323,516 A 6/1994 Hartmann
5,349,725 A 9/1994 Levy
5,367,891 A 11/1994 Furuyama et al.
5,889,737 A 3/1999 Alameh et al.
5,977,888 A 11/1999 Fujita et al.
(Continued)

FOREIGN PATENT DOCUMENTS

CN 2497586 7/2002
CN 1395896 2/2003
(Continued)

*Primary Examiner* — Corey Skurdal
(74) *Attorney, Agent, or Firm* — Morgan, Lewis & Bockius LLP

(57) ABSTRACT

A magnetic band clasp includes a female clasp assembly of a first band segment and a male clasp assembly of a second band segment. The female clasp assembly defines one or more cavities with one or more magnetic elements disposed underneath. The male clasp assembly includes a projection that may include a magnetic element. Magnetic attraction between the magnetic elements couples the first and second band segments when the projection is positioned in the cavity. In implementations where the female clasp assembly includes multiple cavities, changing which of the cavities the projection is positioned in adjusts a combined coupled length of the first and second band segments.

19 Claims, 11 Drawing Sheets

(56) References Cited

U.S. PATENT DOCUMENTS

| | | | | |
|---|---|---|---|---|
| 6,050,931 | A | 4/2000 | Russell | |
| 6,598,271 | B2 | 7/2003 | Nire | |
| 6,598,272 | B2 | 7/2003 | Nire | |
| 7,043,740 | B2 | 5/2006 | Chen et al. | |
| 7,152,282 | B2 | 12/2006 | Costa et al. | |
| 7,308,737 | B2 | 12/2007 | Saitoh et al. | |
| 7,496,994 | B1 | 3/2009 | Headley et al. | |
| 7,667,623 | B2 | 2/2010 | Soh et al. | |
| 7,708,456 | B2 | 5/2010 | Kraus et al. | |
| 8,467,270 | B2 | 6/2013 | Gossweiler, III et al. | |
| 8,505,334 | B2 | 8/2013 | Niikura | |
| 8,717,132 | B2 | 5/2014 | Lancaster-Larocque | |
| 8,937,520 | B2 | 1/2015 | Kan | |
| 8,957,751 | B2 | 2/2015 | Fullerton et al. | |
| 8,978,213 | B2 | 3/2015 | Hayton | |
| 8,985,410 | B2 | 3/2015 | Wishart | |
| 8,994,827 | B2 | 3/2015 | Mistry et al. | |
| 8,997,318 | B2 | 4/2015 | Nicolas et al. | |
| 9,089,193 | B2 | 7/2015 | Casini | |
| 9,141,086 | B1 | 9/2015 | Rohrbach | |
| 2002/0104151 | A1 | 8/2002 | Rauscher | |
| 2003/0229974 | A1 | 12/2003 | Zemer et al. | |
| 2004/0155738 | A1* | 8/2004 | Kraus ..... | A44C 5/14 335/205 |
| 2006/0257190 | A1 | 11/2006 | Chiang | |
| 2011/0048069 | A1 | 3/2011 | Komatsu | |
| 2013/0326790 | A1 | 12/2013 | Cauwels et al. | |
| 2014/0033482 | A1 | 2/2014 | Fullerton et al. | |
| 2014/0077910 | A1 | 3/2014 | Chaizy | |
| 2016/0037875 | A1 | 2/2016 | Rohrbach | |
| 2016/0037879 | A1 | 2/2016 | Qian et al. | |
| 2016/0037896 | A1 | 2/2016 | Kosoglow et al. | |
| 2016/0037897 | A1 | 2/2016 | Bataillou et al. | |
| 2016/0042897 | A1 | 2/2016 | Qian | |

FOREIGN PATENT DOCUMENTS

| | | |
|---|---|---|
| CN | 1794931 | 6/2006 |
| CN | 101657120 | 2/2010 |
| CN | 201440767 | 4/2010 |
| CN | 201683167 | 12/2010 |
| CN | 101384975 | 3/2011 |
| CN | 202154152 | 3/2012 |
| CN | 102481034 | 5/2012 |
| CN | 202233407 | 5/2012 |
| CN | 202533728 | 11/2012 |
| CN | 103164044 | 6/2013 |
| CN | 203314250 | 12/2013 |
| CN | 103504731 | 1/2014 |
| CN | 203469237 | 3/2014 |
| CN | 204838302 | 12/2015 |
| DE | 2323058 | 11/1974 |
| EP | 1980170 | 10/2008 |
| EP | 2532262 | 12/2012 |
| GB | 2099762 | 12/1982 |
| JP | H10165211 | 6/1998 |
| JP | 2004166895 | 6/2004 |
| JP | 2011078524 | 4/2011 |
| KR | 1020050105950 | 4/2006 |
| WO | WO2007/114631 | 10/2007 |
| WO | WO2013090198 | 6/2013 |
| WO | WO03/056956 | 7/2013 |
| WO | WO2015/028044 | 3/2015 |

* cited by examiner

MAGNETIC BAND CLASP

CROSS-REFERENCE TO RELATED APPLICATION(S)

This application is a nonprovisional patent application of and claims the benefit of U.S. Provisional Patent Application No. 62/219,562, filed Sep. 16, 2015 and titled "Magnetic Band Clasp," the disclosure of which is hereby incorporated herein by reference in its entirety.

FIELD

The described embodiments relate generally to attachment mechanisms. More particularly, the present embodiments relate to magnetic band clasps for wearable electronic devices.

BACKGROUND

Many different devices include attachment mechanisms that can be used to attach the devices to various objects. Some attachment mechanisms may be used to mount a device to another object, such as the dashboard of a motor vehicle. Other attachment mechanisms may be used to attach the device to a user. Bands, lanyards, tethers, and the like fall into this latter category.

Many bands include a clasp that is operable to secure two band segments around a body part of a user, such as the user's arm or wrist. Often, such a clasp may include a buckle with a tongue affixed to a first band segment that interacts with one or more holes on a second band segment. Such a clasp may operate by feeding the second band segment through the buckle and projecting the tongue through one of the holes in the second band segment. Thus, the buckle and the tongue may be positioned proud of the band and exposed when the clasp joins the two band segments.

SUMMARY

The present disclosure relates to magnetic band clasps. A female clasp assembly of a first band segment defines one or more cavities with one or more magnetic elements disposed underneath. A male clasp assembly of a second band segment includes a projection having a magnetic element. Magnetic attraction between the magnetic elements couples the first and second band segments when the projection is positioned in the cavity.

In various embodiments, a magnetic band clasp for a wearable electronic device includes a first band segment, a female clasp assembly coupled to the first band segment, a second band segment, and a male clasp assembly coupled to the second band segment. The female clasp assembly includes a female mating component defining a cavity and a female magnetic element coupled to the female mating component. The female mating component includes an alignment feature.

The male clasp assembly includes a male mating component having a projection and a male magnetic element coupled to the male mating component. Magnetic attraction between the male magnetic element and the female magnetic element couples the first and second band segments when the projection is positioned in the cavity. The alignment feature guides inserting the projection into the cavity. The first band segment obscures the projection when the projection is positioned in the cavity.

In some examples, the male magnetic element may be a permanent magnet and the female magnetic element may be ferromagnetic material. The female mating component may be formed of a nonmagnetic material. The female mating component may be at least one of plastic or metal.

In various examples, the alignment feature may be a tapered edge adjacent the cavity. The edge may be curved.

In some embodiments, an adjustable band for a wearable electronic device includes a first band segment, sockets defined in the first band segment, a set of first band segment magnetic elements that are each disposed under one of the sockets, a second band segment, a protrusion coupled to the second band segment, and a protrusion magnetic element coupled to the protrusion. Magnetic attraction between the protrusion magnetic element and one of the set of first band segment magnetic elements couples the first and second band segments when the protrusion is positioned in the one of the sockets.

In various examples, the adjustable band may include adhesive bonding the protrusion magnetic element to the protrusion. The adjustable band may also include adhesive bonding the protrusion to the second band segment.

In some examples, the adjustable band may include a first retaining structure and a second retaining structure. The protrusion may be disposed on the first retaining structure. The first retaining structure may be bonded to a shelf located in an aperture defined by the second band segment. The second retaining structure may be bonded to the shelf opposite the first retaining structure. A portion of the first retaining structure may be positioned within a cavity defined by the second retaining structure.

In various examples, the protrusion may be covered by the first band segment when the first and second band segments are coupled. In some examples, the first band segment and the second band segment may be formed of at least one of silicone, fluoroelastomer, or leather.

In various embodiments, a method of constructing a band clasp may include molding a first band segment around ferromagnetic materials to define recesses where each of the recesses are proximate to one of the ferromagnetic materials, bonding a permanent magnet to a plug, and bonding the plug to a second band segment such that the first band segment and second band segment are coupleable via magnetic attraction between the permanent magnet and one of the ferromagnetic materials when the plug is inserted into one of the recesses.

In some examples, molding the first band segment around the ferromagnetic materials to define the recesses may include configuring the recesses in mounts, bonding the ferromagnetic materials to surfaces of the mounts opposite the recesses, and molding the first segment around the mounts. In various examples, the operation of molding the first band segment around the ferromagnetic materials to define the recesses may include forming at least one curved corner proximate to each of the recesses.

In some examples, the method may also include subjecting the first band segment to a magnetic field to magnetize the ferromagnetic materials. The operation of subjecting the first band segment to the magnetic field may be performed during molding of the first band segment. In various examples, the method may also include configuring the second band segment with a recessed shelf wherein the bonding the plug to the second band segment includes bonding the plug to the recessed shelf.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
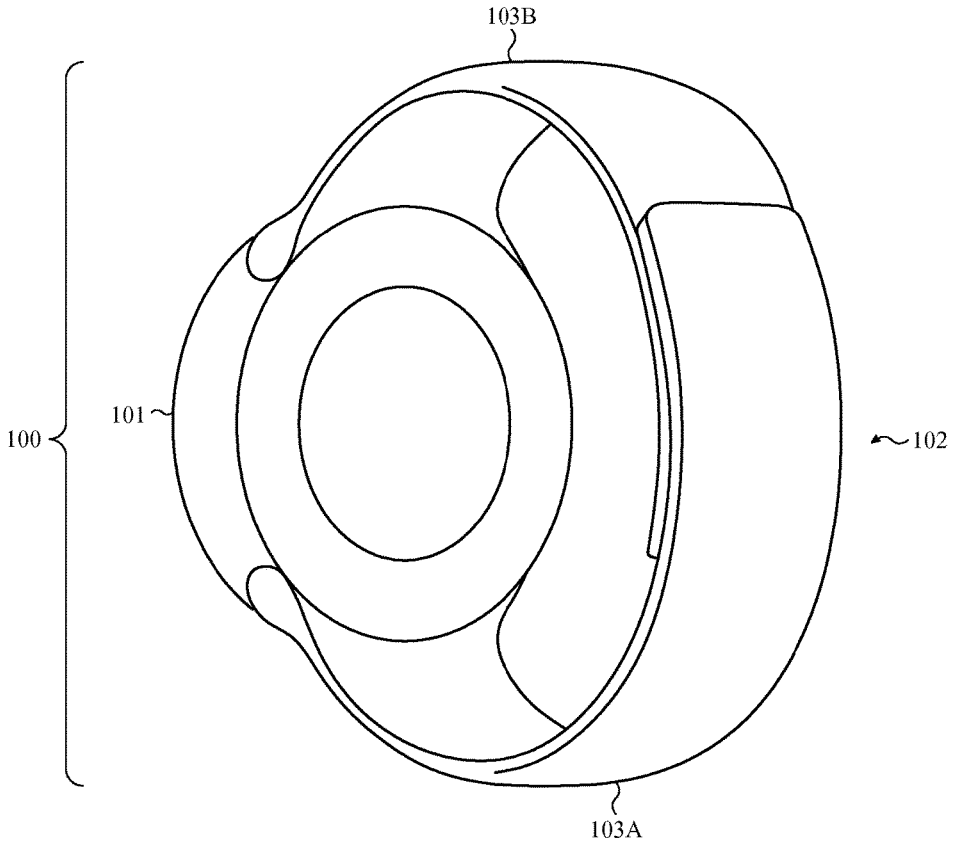
FIG. 1 depicts a wearable electronic device having a band with a magnetic band clasp.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The description that follows includes sample systems, methods, and apparatuses that embody various elements of the present disclosure. However, it should be understood that the described disclosure may be practiced in a variety of forms in addition to those described herein.

The following disclosure relates to magnetic band clasps for wearable electronic devices. A female clasp assembly of a first band segment defines one or more cavities with one or more magnetic elements disposed underneath. A male clasp assembly of a second band segment includes a projection having a magnetic element. Magnetic attraction between the magnetic elements couples the first and second band segments when the projection is positioned in the cavity. This may allow for simple and efficient coupling and decoupling of the band segments without using traditional clasping mechanisms that project through band segments and/or have exposed portions during use that can damage other surfaces. In implementations where the female clasp assembly includes multiple cavities, changing which of the cavities the projection is positioned in adjusts a combined coupled length of the first and second band segments.

In some implementations, the cavity is defined in a female mating component incorporated into the female clasp assembly. In some examples of such an implementation, the magnetic element of the female clasp assembly is coupled to the female mating component before the female mating component is coupled to the first band segment. In other implementations, the cavity may be formed on the first band segment that has the magnetic element of the female clasp assembly embedded therein.

In various implementations, an alignment feature is positioned around the cavity. The alignment feature guides inserting the projection into the cavity. For example, the alignment feature may have edges or corners adjacent the cavity that are tapered or curved such that a mouth of the cavity is wider than the interior of the cavity. Thus, the mouth of the cavity is wider than the projection to guide inserting the projection.

In some implementations, the magnetic element of the female clasp assembly may be a ferromagnetic material (e.g., materials that can be magnetized by an external magnetic field and remain magnetized after the external field is removed) and the magnetic element of the male clasp assembly may be a permanent magnet (e.g., a magnetized material that creates its own persistent magnetic field). In such an implementation, the first band segment may be molded around the ferromagnetic material and the projection may be bonded to the second band segment.

These and other embodiments are discussed below with reference to FIGS. 1-10. However, those skilled in the art will readily appreciate that the detailed description given herein with respect to these Figures is for explanatory purposes only and should not be construed as limiting.

Figure 2:
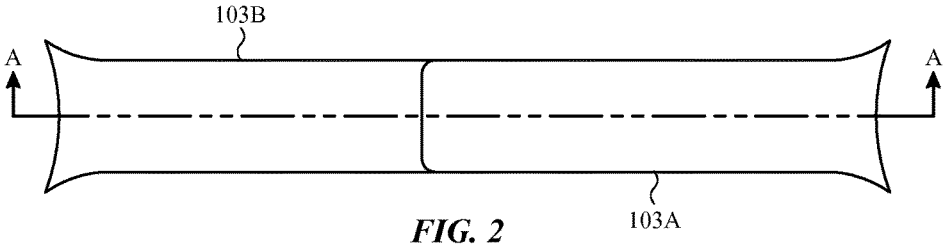
FIG. 2 depicts the clasped first and second band segments of FIG. 1 with the main body of the wearable electronic device removed.

FIG. 1 depicts a wearable electronic device 100 having a band 102 with a magnetic band clasp. The wearable electronic device 100 may include a main body 101 that may be coupled and/or otherwise attached to a user's body part (such as the user's wrist) by clasping a first band segment 103A with a second band segment 103B (which may be formed of various flexible materials such as silicone, fluoroelastomer, leather, and so on). FIG. 2 depicts the clasped first and second band segments 103A and 103B of FIG. 1. For purposes of clarity, the main body 101 of the wearable electronic device 100 removed and the first and second band segments 103A and 103B are arranged flat. As shown, the first and second band segments 103A and 103B overlap when coupled.

Figure 3A:
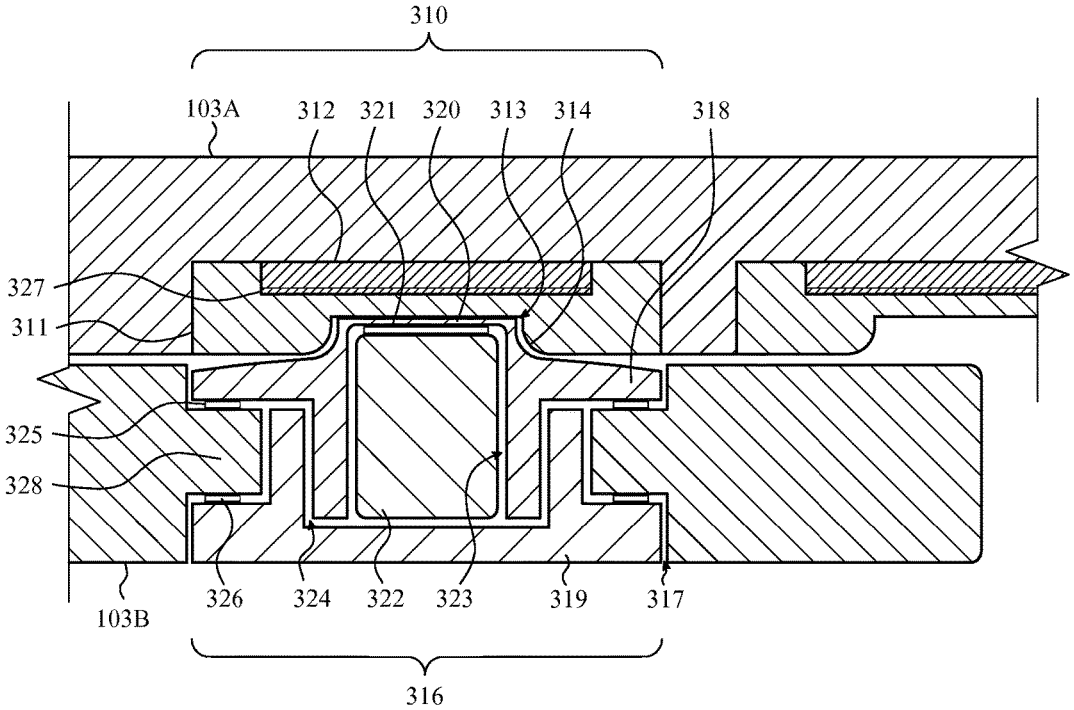
FIG. 3A depicts a cross-sectional view of the clasped first and second band segments of FIG. 2, taken along line A-A of FIG. 2.

FIG. 3A depicts a cross-sectional view of the clasped first and second band segments 103A and 103B of FIG. 2, taken along line A-A of FIG. 2. One or more female clasp assemblies 310 coupled to the first band segment 103A may interact with a male clasp assembly 316 coupled to the second band segment 103B to clasp the first and second band segments 103A and 103B.

The female clasp assembly 310 is referred to as "female" because it receives at least a portion of the male clasp assembly 316. Similarly, the male clasp assembly 316 is referred to as "male" because at least a portion of the male clasp assembly 316 is received by the female clasp assembly 310.

The female clasp assembly 310 may define a cavity 313 (also encompassing a socket, recess, indent, depression, aperture, and so on) in which a projection 320 (also encompassing a protrusion, plug, protuberance, knob, and so on) may be positioned by inserting the projection 320 at least partially into the cavity 313. Magnetic attraction between one or more female magnetic elements 312 coupled to the first band segment 103A (or a set of first band segment magnetic elements) and a male magnetic element 322 coupled to the projection 320 (or a projection or protrusion magnetic element) may couple the first and second band segments 103A and 103B when the projection 320 is positioned in the cavity.

The female clasp assembly 310 may include an alignment feature 314 that aids insertion of the projection 320 into the cavity 313. In this implementation, the alignment feature 314 may be an edge adjacent to the cavity that is curved, tapered, or otherwise shaped such that a mouth of the cavity is wider than an interior of the cavity. The interior of the cavity 313 may have one or more dimensions sized correspondingly to the projection 320. As the mouth of the cavity 313 has wider dimensions than the projection 320 due to the curved edges of the alignment feature 314, a user may be more easily able to insert the projection 320 at least partially into the cavity 313 than if the mouth of the cavity matched the dimensions of the projection 320 more closely. The curved surface may also guide the projection 320 into the cavity 313.

The female clasp assembly 310 may include one or more female mating components 311 (also encompassing a mount). The female mating component 311 may define the cavity 313. Further, the alignment feature 314 may be part of the female mating component 311, such as a part of an exterior surface. In various implementations, the female mating component 311 may be formed of stainless steel or other metals, plastic, elastomer, and/or other materials. Optionally, such materials may be nonmagnetic. The female magnetic element 312 may be bonded to the female mating component 311, such as using adhesive 327.

However, it is understood that this is an example. In various implementations, the cavities 313 may be formed on the first band segment 103A and the female mating components 311 may be omitted. In such an implementation, the female magnetic elements 312 may be embedded in the first band segment 103A, for example disposed under the cavities 313.

The male clasp assembly 316 includes a first retaining structure 318 and a second retaining structure 319 that together form a male mating component. The first and second retaining structures 318 and 319 may be positioned in an aperture 317 of the second band segment 103B. The first and second retaining structures 318 and 319 may be bonded to opposite sides of a shelf 328 positioned in the aperture 317, such as via adhesives 325 and 326. As illustrated, the shelf 328 is configured as a ring. However, in other examples the shelf 328 may be annular, be configured as multiple separate shelves around the aperture 317, and/or be otherwise configured. Similarly, the adhesives 325 and 326 are shown as rings but may be annular, be configured as multiple separate adhesive sections around the shelf 328, and/or be otherwise configured. The second retaining structure 319 may define a cavity 324 in which a portion of the first retaining structure 318 is positioned after the first and second retaining structures 318 and 319 are bonded to opposite sides of the shelf 328.

Although the projection 320 is illustrated and described as bonded to the second band segment 103B via the first retaining structure 318, it is understood that this is an example. In various implementations, the projection 320 may be formed from the second band segment 103B without departing from the scope of the present disclosure.

The projection 320 may be disposed on and form part of the first retaining structure 318. The first retaining structure 318 may define a recess 323 on an opposing side and underneath (from the perspective shown in FIG. 3A) the projection 320. The male magnetic element 322 may be positioned in the recess 323 and bonded thereto, such as using adhesive 321. Thus, the male magnetic element 322 may be bonded to the projection 320.

Although the male magnetic element 322 is illustrated and described as bonded to the projection 320, it is understood that this is an example. In various implementations, the projection 320 itself may be magnetic and a separate male magnetic element 322 may be omitted without departing from the scope of the present disclosure.

In various implementations, the female magnetic element 312 may be a ferromagnetic material (and/or a resin and/or other material doped with ferromagnetic material) and the male magnetic element 322 may be a permanent magnet (though in other implementations the female magnetic element 312 may be a permanent magnet and the male magnetic element 322 may be a ferromagnetic material). This may allow magnetic attraction between the female and male magnetic elements 312 and 322 while allowing the first band segment 103A to be molded around the female magnetic element 312. Molding may involve subjecting the female magnetic element 312 to high temperatures. Exposure to high temperatures may degrade the performance of permanent magnets. Thus, using ferromagnetic material for the female magnetic element 312 instead of a permanent magnet may avoid degradation from molding temperatures. As bonding may not expose the male magnetic element 322 to molding temperatures, bonding the male clasp assembly 316 to the second band segment 103B may allow use of the permanent magnet without degradation.

However, it is understood that this is an example. In other implementations, ferromagnetic material may be used for the female magnetic element 312 and may be magnetized after the first band segment 103A is molded around the female magnetic element 312. This may be accomplished by subjecting the first band segment 103A to a magnetic field. In this way, the female magnetic element 312 may be magnetized without degrading performance due to the high temperatures of molding.

Further, in other implementations, the female magnetic element 312 may be bonded to the first band segment 103A. Similarly, the second band segment 103B may be molded around the male magnetic element 322. In such an implementation, the female magnetic element 312 may be a permanent magnet and the male magnetic element may be a ferromagnetic material.

Additionally, in still other implementations, the second band segment 103B may be molded around a ferromagnetic material that forms the male magnetic element 322 and is subsequently magnetized. In this way, the male magnetic element 322 may be magnetized without degrading performance due to the high temperatures of molding.

Figure 3B:
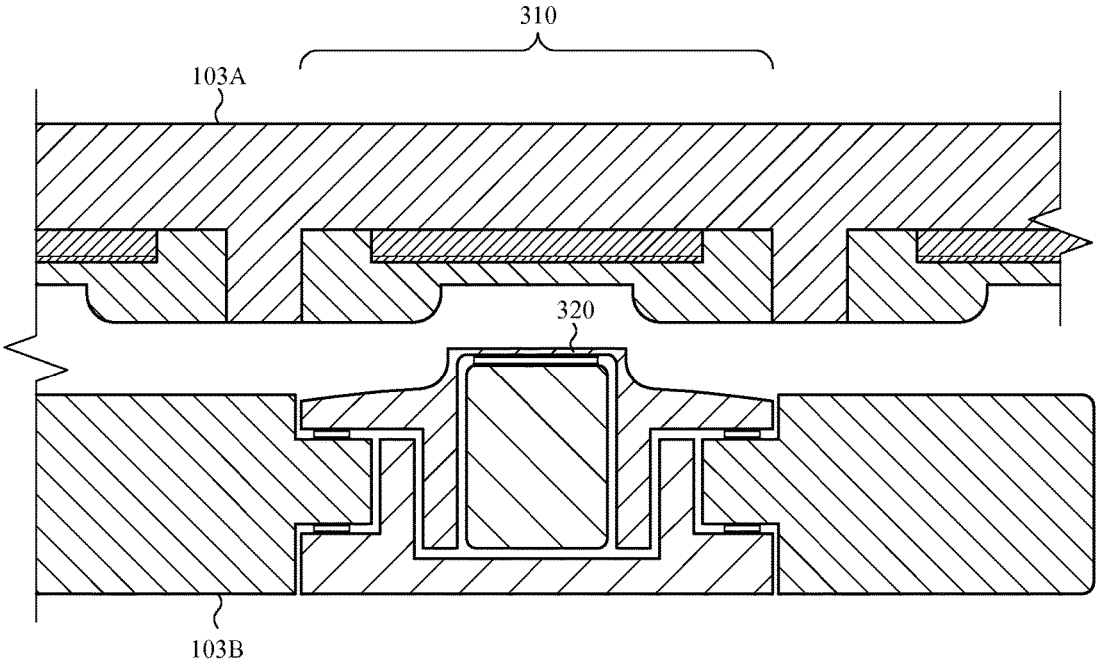
FIG. 3B depicts removal of the projection of the male clasp assembly from one of the cavities.
Figure 3C:
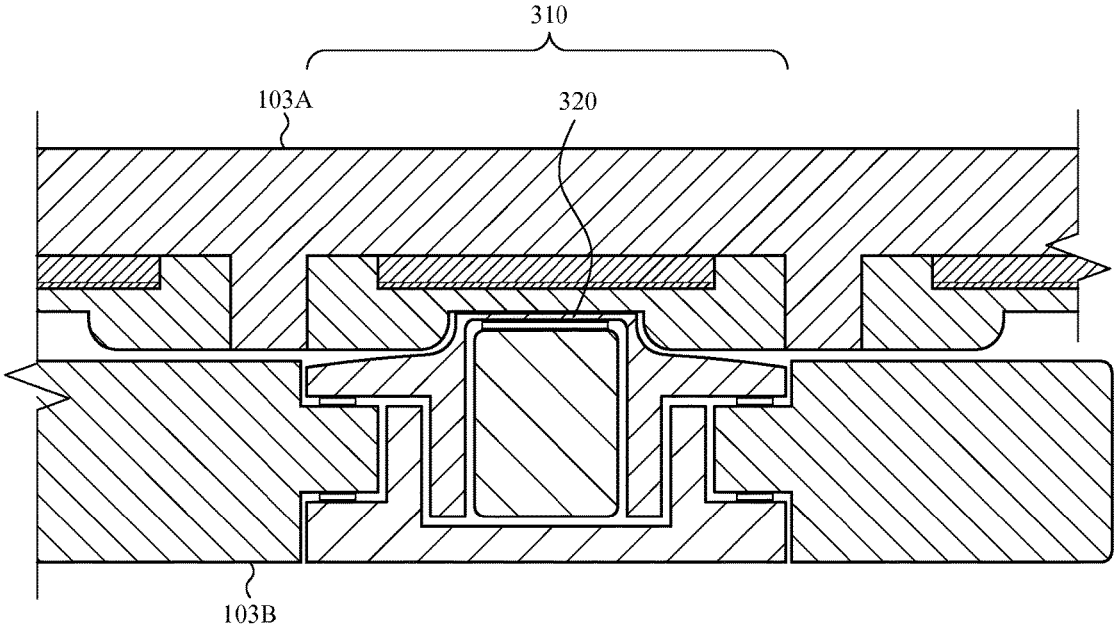
FIG. 3C depicts positioning of the removed projection in another of the cavities.

FIG. 3B depicts removal of the projection 320 of the male clasp assembly 316 from one of the cavities 313. FIG. 3C depicts positioning of the removed projection 320 in another of the cavities 313. As the cavities are variously positioned along the first band segment 103A, changing the cavity 313 in which the projection 320 in is positioned may adjust a combined coupled length of the first and second band segments.

Figure 4A:
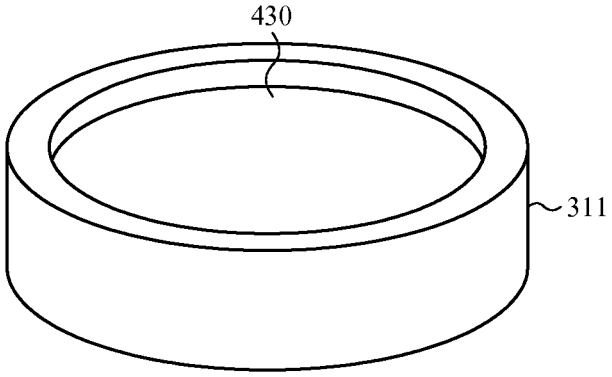
FIG. 4A depicts a female mating component of FIG. 3A.
Figure 4B:
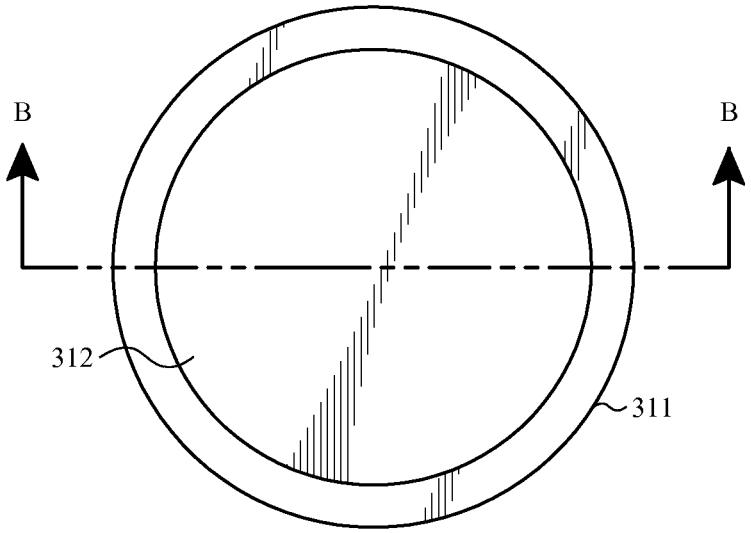
FIG. 4B depicts a top view of the female mating component of FIG. 4A after bonding of the female magnetic element to a recess.
Figure 4C:
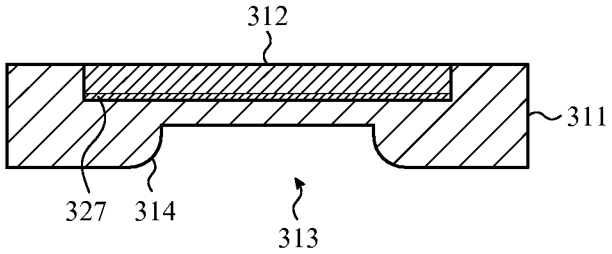
FIG. 4C depicts a cross-sectional view of the bonded female mating component of FIG. 4B, taken along line B-B of FIG. 4B.
Figure 4D:
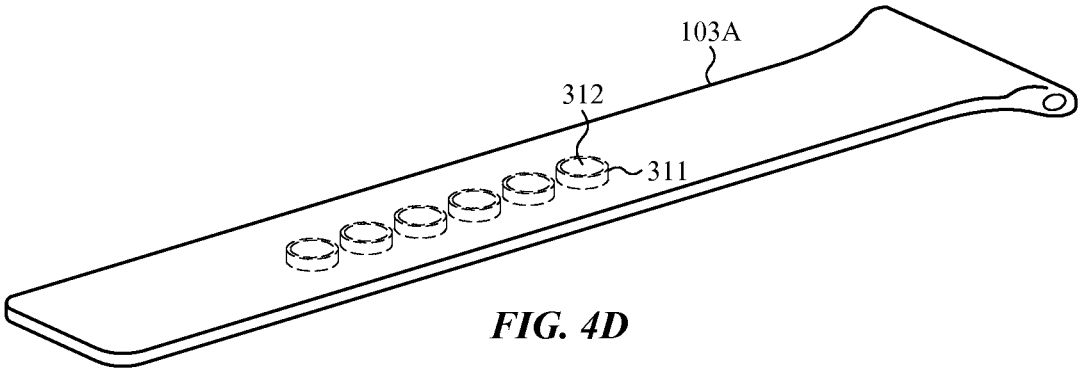
FIG. 4D depicts the first band segment, showing the band molded around female mating components.

FIG. 4A depicts the female mating component 311 by itself. The female mating component 311 may include a recess 430 into which the female magnetic element 312 may be bonded. FIG. 4B depicts a top view of the female mating component 311 after bonding of the female magnetic element 312. FIG. 4C depicts a cross-sectional view of the female mating component 311 of FIG. 4B, taken along line B-B of FIG. 4B. As shown, the female magnetic element 312 is bonded to the female mating component 311, via the adhesive 327, and on an opposite side of the female mating component 311 from the alignment feature 314. FIG. 4D depicts the first band segment 103A, after molding of the first band segment 103A around female magnetic elements 312 and the female mating components 311. Though FIG. 4D illustrates six aligned female mating components 311, it is understood that this is an example. In various implementations, other numbers of female mating components 311 may be arranged in various configurations without departing from the scope of the present disclosure.

Figure 5A:
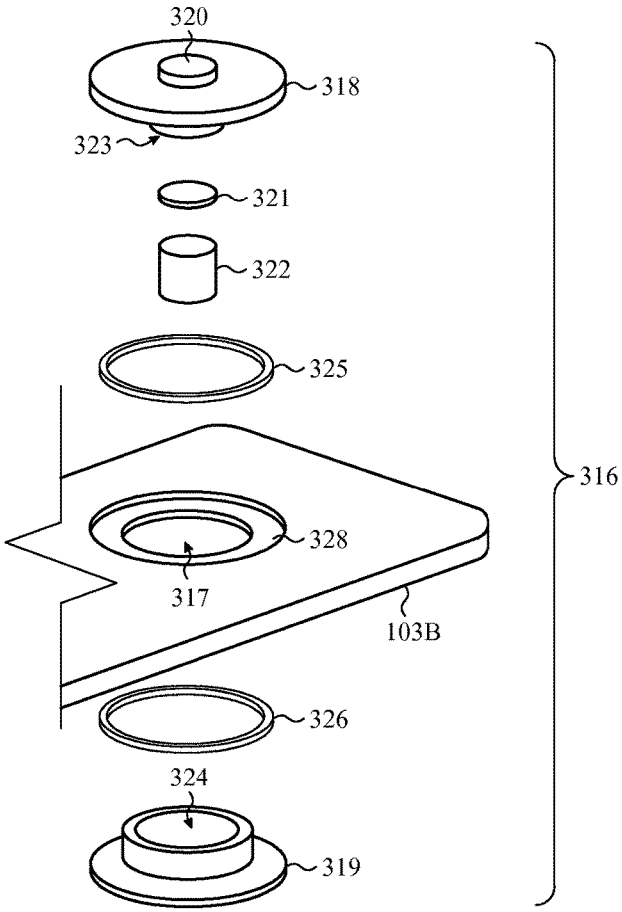
FIG. 5A depicts an exploded view of the male clasp assembly coupled to the second band segment, illustrating how the components of the male clasp assembly couple to the second band segment.
Figure 5B:
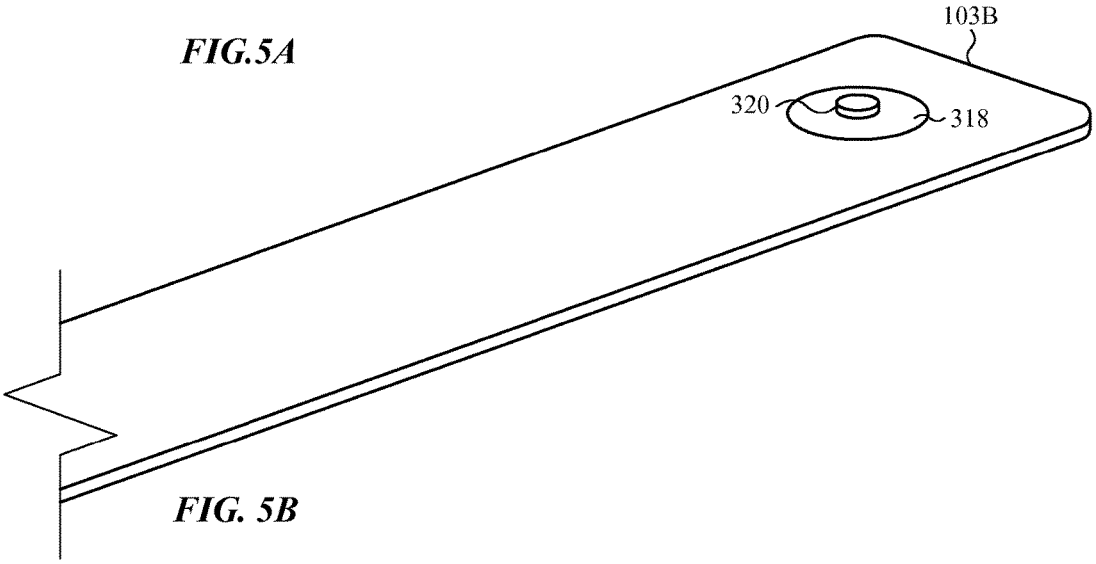
FIG. 5B depicts an assembled view of the male clasp assembly coupled to the second band segment, illustrating how the components of the male clasp assembly couple to the second band segment.

FIGS. 5A-5B depict exploded and assembled views of the male clasp assembly 316 coupled to the second band segment 103B. As illustrated, the second retaining structure 319 may be bonded to the shelf 328, which is positioned in the aperture 317, by the adhesive 326. The male magnetic element 322 may be affixed in the recess 323 of the first retaining structure 318 by the adhesive 321. The first retaining structure 318 may be bonded to the shelf 328 (on an opposite side of the shelf 328 to which the second retaining structure 319 is bonded) by the adhesive 325, thus positioning part of the first retaining structure 318 in the cavity 324 of the second retaining structure 319.

As illustrated in FIG. 5B, the components of the male mating clasp assembly 316 (other than the projection 320) may be flush and/or recessed into the second band segment 103B after coupling. This may prevent the components of the male mating clasp assembly 316 other than the projection 320 from scratching and/or otherwise contacting objects during use. Further, as shown in FIGS. 1-3C, the first band segment 103A may obscure the projection 320 when the first and second band segments 103A and 103B are clasped as the projection 320 is positioned in a cavity 313 and covered by the first band segment 103A. As such, the projection 320 may also be prevented from scratching and/or otherwise contacting objects during use.

Although the above illustrates and describes the female and male magnetic elements 312 and 322 as configured such that they attract each other whenever the projection 320 is positioned in the cavity 313, it is understood that this is an example. In various implementations, the female and male magnetic elements 312 and 322 may be configured such that they magnetically attract each other in certain positions and do not attract each other, attract each other less strongly, and/or repel each other in other positions.

For example, the female and male magnetic elements 312 and 322 may be configured with surfaces having polarity patterns made up of multiple positive and negative areas. The positive and negative areas on the surfaces of the female and male magnetic elements 312 and 322 may oppose each other (e.g., positive areas of one surface aligned with negative areas of the opposing surface and so on) when the projection 320 is positioned in the cavity 313 and the first and second band segments 103A and 103B are aligned lengthwise, thus magnetically attracting the female and male magnetic elements 312 and 322 to each other. Rotating the first or second band segments 103A and 103B may move the female and male magnetic elements 312 and 322 with respect to each other such that the positive and negative areas on the surfaces no longer oppose and may match (e.g, positive areas of one surface aligned with positive areas of the opposing surface and so on). In such a position, the female and male magnetic elements 312 and 322 may no longer attract each other and/or may repel each other, aiding in decoupling of the first and second band segments 103A and 103B.

By way of another example, the female and male magnetic elements 312 and 322 are illustrated as circularly shaped components. As such, the female and male magnetic elements 312 and 322 may be aligned each other whenever the projection 320 is positioned in the cavity 313 regardless of the orientation of the female and male magnetic elements 312 and 322 with respect to each other. However, in various implementations, the female and male magnetic elements 312 and 322 may be shaped such that they are aligned in some orientations with respect to each other but not in others.

For example, the female and male magnetic elements 312 and 322 may be configured as triangularly shaped components with corresponding triangularly shaped gaps or non-magnetic materials positioned there between. In such an example, the triangularly shaped female and male magnetic elements 312 and 322 may align (and thus magnetically attract) when the projection 320 is positioned in the cavity 313 and the first and second band segments 103A and 103B are aligned lengthwise. However, when the first and second band segments 103A and 103B are moved such that they are not aligned lengthwise, the triangularly shaped female and male magnetic elements 312 and 322 may be misaligned. When the triangularly shaped female and male magnetic elements 312 and 322 are misaligned, they may no longer magnetically attract each other or may not as strongly attract each other.

Additionally, in some implementations, though the above describes moving the first and/or second band segments 103A and 103B to change the orientations of the female and male magnetic elements 312 and 322, it is understood that this is an example. In some implementations, orientations of the female and male magnetic elements 312 and 322 may be changeable by a movement mechanism incorporated into the first and/or second band segment 103A and 103B.

For example, the female and/or male magnetic elements 312 and 322 may be mounted on a gear system that is connected to a button or other input mechanism. The gear system can be actuated by a user via the input mechanism. When actuated, gears of the gear system move and transfer such motion to the female and/or male magnetic elements 312 and 322. Movement of the female and/or male magnetic elements 312 and 322 changes the orientations of the female and/or male magnetic elements 312 and 322. Changing the orientations of the female and/or male magnetic elements 312 and 322 may couple, decouple, and/or aid in decoupling the first and second band segments 103A and 103B.

Further, the female mating component 311 is illustrated as surrounding a perimeter of the projection 320 when the projection 320 is positioned in the cavity 313. As such, the female and male magnetic elements 312 and 322 may be moved further apart from each other in order to decouple the first and second band segments 103A and 103B. Motion of the female and male magnetic elements 312 and 322 with respect to each other may be difficult due to magnetic attraction, as compared to moving the female and male magnetic elements 312 and 322 laterally with respect to each other (e.g., in a shear direction). Since the female mating component 311 surrounds the perimeter of the projection 320, the projection 320 is prevented from moving such that the female and male magnetic elements 312 and 322 move laterally with respect to each other.

However, in some implementations, a gap may be configured in the female mating component 311 so that the female and male magnetic elements 312 and 322 can be moved laterally with respect to each other until they no longer attract, or do not attract, one another as strongly. In some examples, the gap may substantially correspond to the dimensions of the projection 320. This may enable the projection 320 to move through the gap while reducing the possibility that the projection will move through the gap when not moved by a user, which may result in unintentionally decoupling the first and second band segments 103A and 103B.

Further, such a gap may be formed on the female mating component 311 to reduce the possibility that the projection 320 will move through the gap without being intentionally moved by a user. For example, the tension between the first and second band segments 103A and 103B related to being coupled around a user's body part may exert force on the male and female mating components 311 and 316 in a direction parallel to the longwise dimension of the first and second band segments 103A and 103B. The gap may be formed perpendicular to the longwise dimension of the first band segment 103A. In this way, the tension between the first and second band segments 103A and 103B related to being coupled would not move the projection through the gap. Instead, the male and female mating components 311 and 316 may remain coupled until a force is exerted by a user perpendicular to the longwise dimension of the first band segment 103A in the direction of the gap to move the projection 320 through the gap.

Figure 6A:
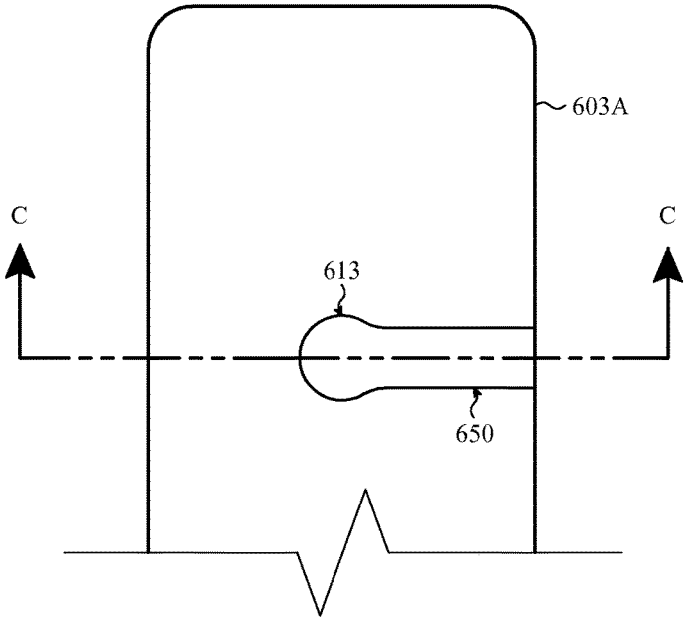
FIG. 6A depicts an additional example of a band segment in accordance with further embodiments.

For example, FIG. 6A depicts an example band segment 603A that includes such a gap 650. As shown, the cavity 613 is connected to the gap 650, which extends through to the edge of the band segment 603A. A projection of a male mating component of a band segment such as the second band segment 103B of FIG. 3A may be moved through the gap 650 into the cavity 613 perpendicularly with respect to the longwise dimension of the band segment 603A to couple the band segment with the example band segment 603A. Conversely, the projection may be moved from the cavity 613 out through the gap 650 perpendicularly with respect to the longwise dimension of the band segment 603A to decouple couple the band segment from the example band segment 603A.

Figure 6B:
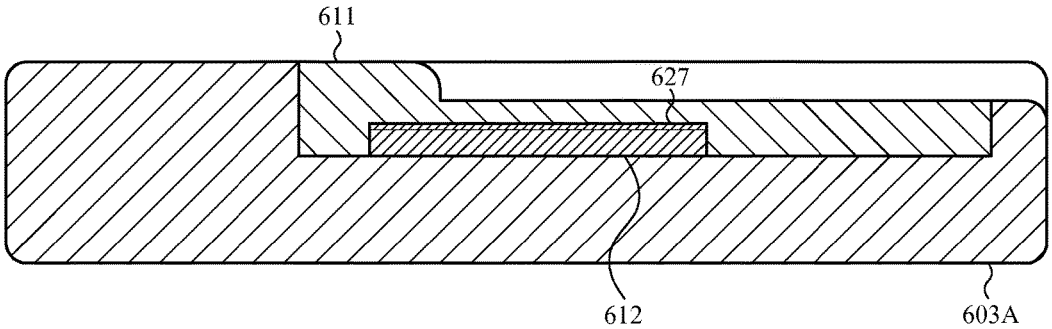
FIG. 6B depicts a cross-sectional view of the band segment of FIG. 6A, taken along line C-C of FIG. 6A.

FIG. 6B depicts a cross-sectional view of the example band segment 603A of FIG. 6A. As shown, the example band segment 603A includes a female mating component 611. The female mating component 611 has a female magnetic element 612 affixed thereto by adhesive 627. The female mating component 611 is shaped to define the gap 650 shown in FIG. 6A.

Additionally, although FIGS. 6A-6B are described as including a gap 650 extending through a dimension of the example band segment 603A, it is understood that this is an example. In various implementations, the cavity 613 may be formed with differing dimensions than a projection of a male mating component of a band segment (such as the second band segment 103B of FIG. 3A) that may be coupled to the example band segment 603A. The female magnetic element 612 may be positioned on or under a portion of such a cavity 613 and not on or under other portions such that the projection may be translated within the cavity 613 to couple and/or decouple the band segment and the example band segment 603A. In such an implementation, the cavity 613 may thus not extend through the example band segment 603A.

Figure 7A:
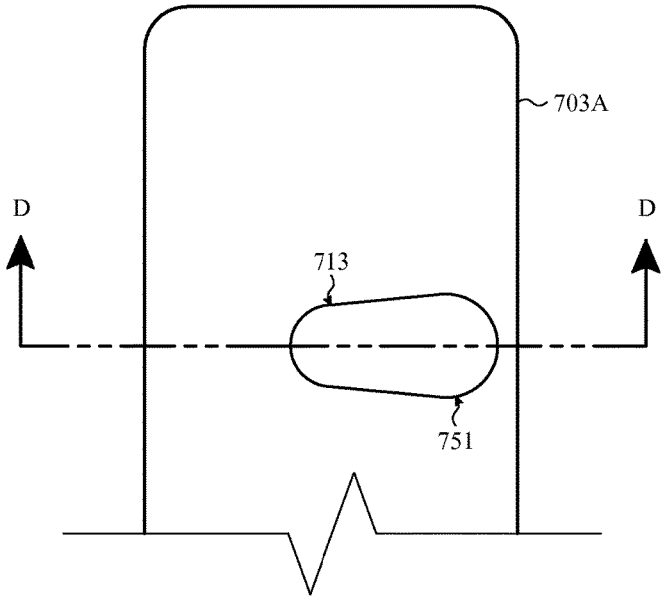
FIG. 7A depicts an additional example of a band segment in accordance with further embodiments.

For example, FIG. 7A depicts an example band segment 703A that includes a cavity 713 connected to a channel 751. The dimensions of the cavity 713 may correspond to a projection of a male mating component of a band segment (such as the second band segment 103B of FIG. 3A) that may be coupled to the example band segment 703A. One or more dimensions of the channel 751 may be larger than the projection. The projection inserted into the channel 751 and then moved into the cavity 713 to couple the band segment and the example band segment 703A. Conversely, the projection may be moved from the cavity 713 into the channel 751 and removed therefrom to decouple couple the band segment from the example band segment 703A. Further, the larger dimension of the channel 751 as compared to the projection may guide insertion of the projection into the channel 751.

Figure 7B:
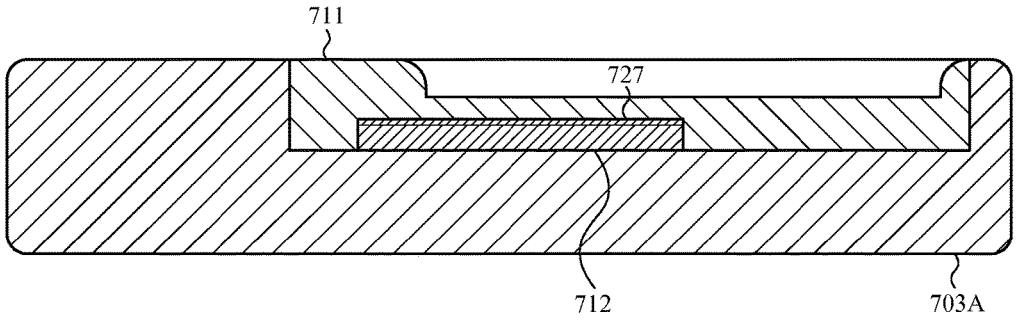
FIG. 7B depicts a cross-sectional view of the band segment of FIG. 7A, taken along line D-D of FIG. 7A.

FIG. 7B depicts a cross-sectional view of the example band segment 703A of FIG. 7A. As shown, the example band segment 703A includes a female mating component 711. The female mating component 711 has a female magnetic element 712 affixed thereto by adhesive 727. The female mating component 711 is shaped to define the cavity 713 and the channel 751 shown in FIG. 7A. As shown, the female magnetic element 712 is positioned on the female mating component 711 so as to align with a male magnetic element of the projection when the projection is positioned in the cavity 713, but not when the projection is positioned in the channel 751.

Figure 8:
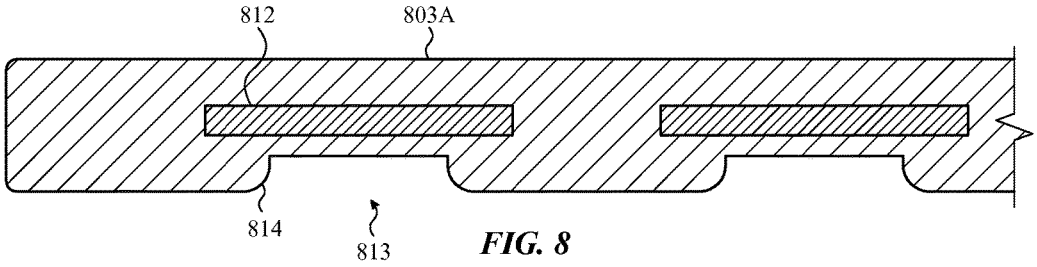
FIG. 8 depicts a cross-sectional view of an additional example of a band segment in accordance with further embodiments.
Figure 9:
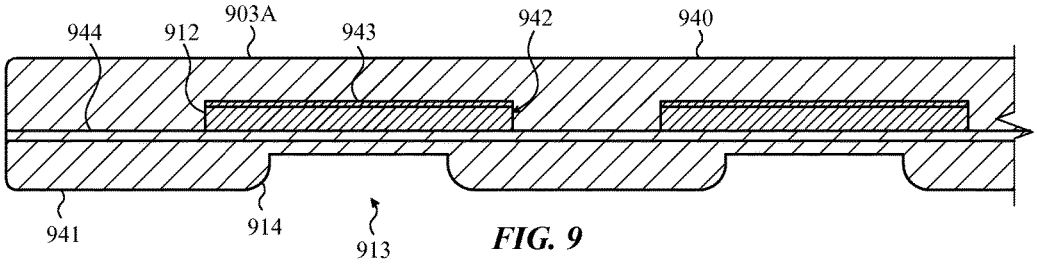
FIG. 9 depicts a cross-sectional view of another additional example of a band segment in accordance with further embodiments.

FIGS. 8-9 depict additional examples of a band segments 803A and 803A in accordance with further embodiments. The band segments 803A and/or 903A may be utilized with the second band segment 103B and/or the wearable electronic device 100 of FIG. 1 without departing from the scope of the present disclosure.

In contrast with the first band segment 103A of FIG. 3A, the band segment 803A may have one or more cavities 813 defined in its surface. In this example, the alignment feature 814 may be a shaped edge or corner of the band segment 803A around the cavity 813. The band segment 803A may also include one or more female magnetic elements 812 embedded in the band segment 803A. The female magnetic element 812 may be disposed underneath the cavity 813.

In some implementations, the band segment 803A may be molded around the female magnetic element 812. The female magnetic element 812 may be ferromagnetic material, resin doped with ferromagnetic material, and so on. The female magnetic element 812 may be magnetized after molding by subjecting the band segment 803A to a magnetic field.

Contrasted with the first band segment 103A, the band segment 903A may include an upper portion 940 bonded to a lower portion 941, such as by adhesive 944. The upper portion 940 may be molded to define one or more cavities 942. One or more female magnetic elements 912 (which may be permanent magnets, ferromagnetic material, resin and/or other material doped with ferromagnetic material, and/or other magnetic elements) may be bonded to the upper portion 940 in the cavities 942, again by adhesive 943. The lower portion 941 may be molded to define one or more cavities 913 with alignment features 914 adjacent the cavities. In this way, permanent magnets may be used in the band segment 903A without degrading magnetic performance as the upper and lower portions 940 and 941 may be separately assembled and then bonded together.

Although the above describes affixing the upper portion 940 to the lower portion 941 using adhesive 944 and affixing female magnetic elements 912 to the upper portion 940 using adhesive 943, it is understood that adhesives 933 and 944 are examples. In various implementations, other affixing mechanisms and techniques may be utilized without departing from the scope of the present disclosure. For example, in various implementations, ultrasonic welding may be used.

Although the above describes magnetic clasps in the context of bands, it is understood that this is an example. In various implementations, attachment mechanisms other than bands may be utilized without departing from the scope of the present disclosure.

Further, although the above describes magnetic band clasps in the context of wearable electronic devices, it is understood that this is an example. In various implementations, magnetic clasps may be used with a variety of different devices without departing from the scope of the present disclosure.

Figure 10:
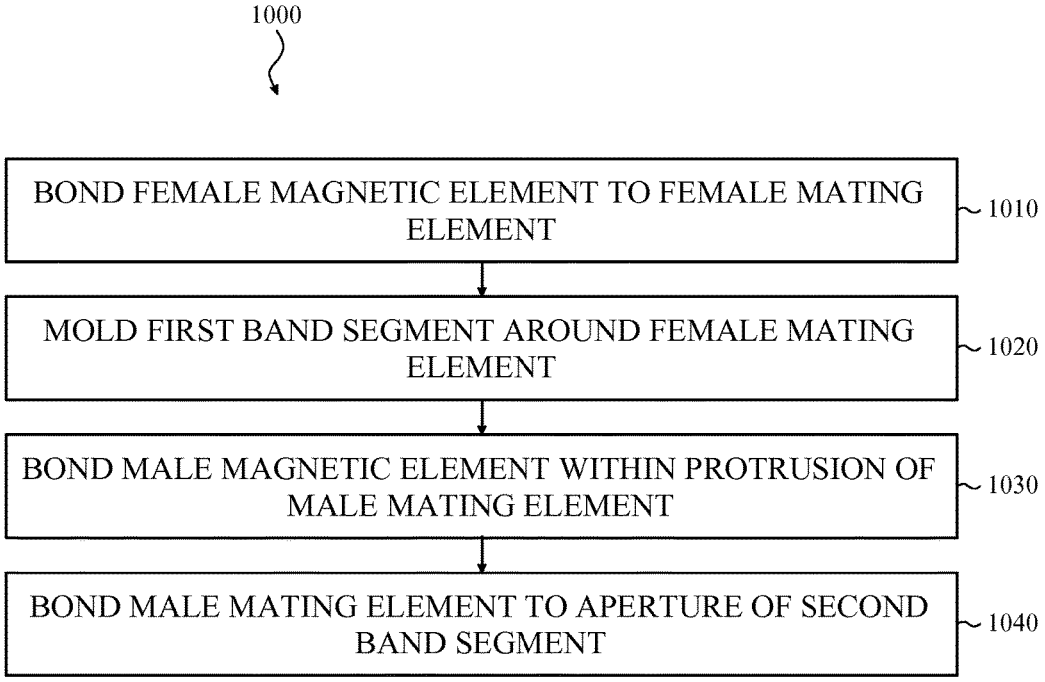
FIG. 10 depicts an example method of forming magnetic band clasp. The example method may form one or more of the magnetic band clasps illustrated in FIGS. 1-7B.

FIG. 10 depicts an example method 1000 of forming magnetic band clasp. The example method 1000 may form one or more of the magnetic band clasps illustrated in FIGS. 1-7B.

At 1010, a female magnetic element is bonded to a female mating component. The female magnetic element may be ferromagnetic material. The female mating component may be nonmagnetic material such as plastic, stainless steel, and so on. The female mating component may have a recess in which the female magnetic element is bonded using adhesive. The female mating component may define a cavity (or recess) on an opposing surface from the recess. The female mating component may also include alignment feature, such as a curved corner or edge, formed adjacent the cavity.

At 1020, a first band segment may be molded around the female mating component. The first band segment may be molded around the female mating component after the female magnetic element is bonded to the female mating component. In some implementations, the first band segment may be molded around multiple female mating components.

At 1030, a male magnetic element may be bonded within a protrusion (or plug) of a male mating component. The male magnetic element may be bonded using adhesive. The male magnetic element may be a permanent magnet. The protrusion may be shaped correspondingly to the cavity defined by the female mating component.

At 1040, the male mating component may be bonded to a second band segment. The male mating component may be bonded to a shelf recessed into an aperture of the second band segment using adhesive. The first and second band segments may be coupleable by inserting the protrusion into the cavity, magnetically coupling the male and female mating components via magnetic attraction of the male and female magnetic elements.

Although the example method 1000 is illustrated and described as including particular operations performed in a particular order, it is understood that this is an example. In various implementations, various orders of the same, similar, and/or different operations may be performed without departing from the scope of the present disclosure.

For example, in some implementations, the example method 1000 may include the additional operation of configuring the cavity in the female mating component prior to bonding the female magnetic elements to surfaces of the female mating components opposite the cavity. Subsequently, the first band segment may be molded around the female mating component. Configuration of the cavity may include forming a curved corner or other alignment feature in the female mating component proximate to the cavity.

By way of another example, in some implementations, the example method 1000 may include the additional operation of subjecting the first band segment to a magnetic field. The operation of subjecting the first band segment to a magnetic field may be performed after molding the first band segment around the female mating components, thus magnetizing the female magnetic elements. However, in some cases, the operation of subjecting the first band segment to a magnetic field may be performed during molding of the first band segment.

By way of another example, in various implementations, the example method 1000 may include configuring the recessed shelf of the second band segment. The operation of configuring the recessed shelf may be performed prior to bonding of the male mating component to the second band segment.

By way of still another example, in various implementations, the example method 1000 may include positioning the female magnetic element proximate to the recess. In various examples, such an operation may be part of molding the first band segment around the female mating component.

As described above and illustrated in the accompanying figures, the present disclosure relates to magnetic band clasps for wearable electronic devices. A female clasp assembly of a first band segment defines one or more cavities with one or more magnetic elements disposed underneath. A male clasp assembly of a second band segment includes a projection having a magnetic element. Magnetic attraction between the magnetic elements couples the first and second band segments when the projection is positioned in the cavity. This may allow for simple and efficient coupling and decoupling of the band segments without using traditional clasping mechanisms that project through band segments and/or have exposed portions during use that can damage other surfaces. In implementations where the female clasp assembly includes multiple cavities, changing which of the cavities the projection is positioned in adjusts a combined coupled length of the first and second band segments.

In the present disclosure, the methods disclosed may be implemented as sets of instructions or software readable or executable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A magnetic band clasp for a wearable electronic device, comprising:

a first band segment comprising a molded elastomer defining a continuous first surface and a second surface opposite the first surface;

a female clasp assembly, coupled to the first band segment, comprising:

a female mating component defining a cavity and including an alignment feature, the female mating component disposed within the molded elastomer along the second surface; and a female magnetic element coupled to the female mating component, wherein the continuous first surface extends across the female mating component and the female magnetic element;

a second band segment; and a male clasp assembly coupled to the second band segment, comprising:

a male mating component including a projection; and a male magnetic element coupled to the male mating component; wherein:

magnetic attraction between the male magnetic element and the female magnetic element couples the first and second band segments when the projection is positioned in the cavity; and the alignment feature guides inserting the projection into the cavity.

2. The magnetic band clasp of claim 1, wherein:

the male magnetic element comprises a permanent magnet; and the female magnetic element comprises ferromagnetic material.

3. The magnetic band clasp of claim 1, wherein the alignment feature comprises a tapered edge adjacent the cavity.

4. The magnetic band clasp of claim 3, wherein the tapered edge is curved.

5. The magnetic band clasp of claim 1, wherein the female mating component comprises at least one of plastic or metal.

6. The magnetic band clasp of claim 1, wherein the female mating component is formed of a nonmagnetic material.

7. The magnetic band clasp of claim 1, wherein the first band segment obscures the projection when the projection is positioned in the cavity.

8. An adjustable band for a wearable electronic device, comprising:

a first band segment comprising a molded elastomer;

sockets defined by the molded elastomer on a side of the first band segment;

first band segment magnetic elements, each of the first band segment magnetic elements being entirely surrounded by the molded elastomer and being aligned with one of the sockets;

a second band segment;

a protrusion coupled to the second band segment; and a protrusion magnetic element coupled to the protrusion;

wherein magnetic attraction between the protrusion magnetic element and one of the first band segment magnetic elements couples the first and second band segments when the protrusion is positioned in the one of the sockets.

9. The adjustable band of claim 8, further comprising adhesive bonding the protrusion magnetic element to the protrusion.

10. The adjustable band of claim 8, further comprising adhesive bonding the protrusion to the second band segment.

11. The adjustable band of claim 8, further comprising a first retaining structure on which the protrusion is disposed, the first retaining structure bonded to a shelf located in an aperture defined by the second band segment.

12. The adjustable band of claim 11, further comprising:

a second retaining structure bonded to the shelf opposite the first retaining structure; wherein a portion of the first retaining structure is positioned within a cavity defined by the second retaining structure.

13. The adjustable band of claim 8, wherein the protrusion is covered by the first band segment when the first and second band segments are coupled together.

14. The adjustable band of claim 8, wherein the first band segment and the second band segment are formed of at least one of silicone or fluoroelastomer.

15. An adjustable band for a wearable electronic device, comprising:

a first band segment comprising:

an upper portion; and a lower portion bonded to the upper portion and defining sockets;

multiple first band segment magnetic elements surrounded by the upper portion and the lower portion, each of the first band segment magnetic elements being aligned with one of the sockets;

a second band segment;

a protrusion coupled to the second band segment; and a protrusion magnetic element coupled to the protrusion;

wherein magnetic attraction between the protrusion magnetic element and one of the first band segment magnetic elements couples the first and second band segments when the protrusion is positioned in the one of the sockets.

16. The adjustable band of claim 15, further comprising adhesive bonding the protrusion magnetic element to the protrusion.

17. The adjustable band of claim 15, further comprising adhesive bonding the protrusion to the second band segment.

18. The adjustable band of claim 15, wherein the protrusion is covered by the first band segment when the first and second band segments are coupled together.

19. The adjustable band of claim 15, wherein the first band segment and the second band segment are formed of at least one of silicone or fluoroelastomer.

* * * * *